US008677712B1

(12) United States Patent
Edmonds, Jr.

(10) Patent No.: US 8,677,712 B1
(45) Date of Patent: Mar. 25, 2014

(54) THERMAL JOINT FOR COLD STORAGE CONSTRUCTION

(71) Applicant: William Leo Edmonds, Jr., Hempstead, TX (US)

(72) Inventor: William Leo Edmonds, Jr., Hempstead, TX (US)

( * ) Notice: Subject to any disclaimer, the term of this patent is extended or adjusted under 35 U.S.C. 154(b) by 0 days.

(21) Appl. No.: 13/897,222

(22) Filed: May 17, 2013

(51) Int. Cl.
*E04B 1/68* (2006.01)

(52) U.S. Cl.
USPC ..... 52/573.1; 52/396.02; 165/53; 237/69

(58) Field of Classification Search
USPC ..... 52/334, 340, 341, 396.05, 395, 393, 52/396.02, 367, 371, 573.1; 404/49, 56, 404/62, 63, 67, 68; 403/28–30; 237/69; 165/54, 53, 48.1, 81, 82
See application file for complete search history.

(56) References Cited

U.S. PATENT DOCUMENTS

| | | | | | |
|---|---|---|---|---|---|
| 2,150,982 | A * | 3/1939 | McFarland | 404/62 |
| 2,179,911 | A * | 11/1939 | Wilmoth | 404/61 |
| 2,181,623 | A * | 11/1939 | Klein | 404/63 |
| 2,365,550 | A * | 12/1944 | Heltzel | 404/59 |
| 2,642,789 | A * | 6/1953 | Brickman | 404/62 |
| 2,726,593 | A * | 12/1955 | Lahti | 454/236 |
| 4,522,531 | A * | 6/1985 | Thomsen et al. | 404/2 |
| 4,752,153 | A * | 6/1988 | Miller | 404/59 |
| 5,910,087 | A * | 6/1999 | Carter | 52/371 |
| 6,354,053 | B1 * | 3/2002 | Kerrels | 52/396.04 |
| 6,598,364 | B1 * | 7/2003 | Pelles | 52/396.02 |
| 8,112,959 | B2 * | 2/2012 | Michiels | 52/396.05 |
| 8,146,377 | B2 | 4/2012 | Karamanos | |
| 2003/0033778 | A1 * | 2/2003 | Boxall et al. | 52/396.02 |
| 2004/0107661 | A1 * | 6/2004 | Michiels | 52/396.05 |
| 2009/0007512 | A1 * | 1/2009 | Kerrels | 52/396.02 |
| 2010/0325996 | A1 * | 12/2010 | Laiho et al. | 52/396.05 |
| 2012/0102862 | A1 * | 5/2012 | Underwood et al. | 52/396.02 |

FOREIGN PATENT DOCUMENTS

| | | | | |
|---|---|---|---|---|
| EP | 442130 | A1 * | 8/1991 | E04B 1/00 |

* cited by examiner

*Primary Examiner* — Robert Canfield
*Assistant Examiner* — Babajide Demuren
(74) *Attorney, Agent, or Firm* — Buskop Law Group, PC; Wendy Buskop

(57) ABSTRACT

A thermal joint having a cold side angle joint; a warm side angle joint; a plurality of bond holes, wherein a liquid curable flooring material bonds through each bond hole; a plurality of rod holes in the warm side thermal wall each holding a rod; a plurality of tube holes in the cold side thermal wall each having a tube; a plurality of leveler holes in each base for containing an adjustable leveler; a tie bar engaging each tube and each rod; a heater conduit longitudinally positioned on the warm side for transferring heat to the warm side, wherein the thermal joint simultaneously allows the rods to slide in the tubes as the cured solid flooring material expands and contracts due to temperature changes and simultaneously prevents vertical deflection as heavy equipment is transported across the cured solid flooring material.

15 Claims, 3 Drawing Sheets

THERMAL JOINT FOR COLD STORAGE CONSTRUCTION

FIELD

The present embodiments generally relate to a thermal joint for cold storage constructions, including cold storage flooring systems.

BACKGROUND

A need exists for a thermal joint which provides strength creating a continuous flooring system structural matrix through the thermal joint, while providing an ability to move with thermal changes and prevents vertical deflection when several thousand pounds of load are placed on the flooring system.

The present embodiments meet these needs.

BRIEF DESCRIPTION OF THE DRAWINGS

The detailed description will be better understood in conjunction with the accompanying drawings as follows.

Figure 1:
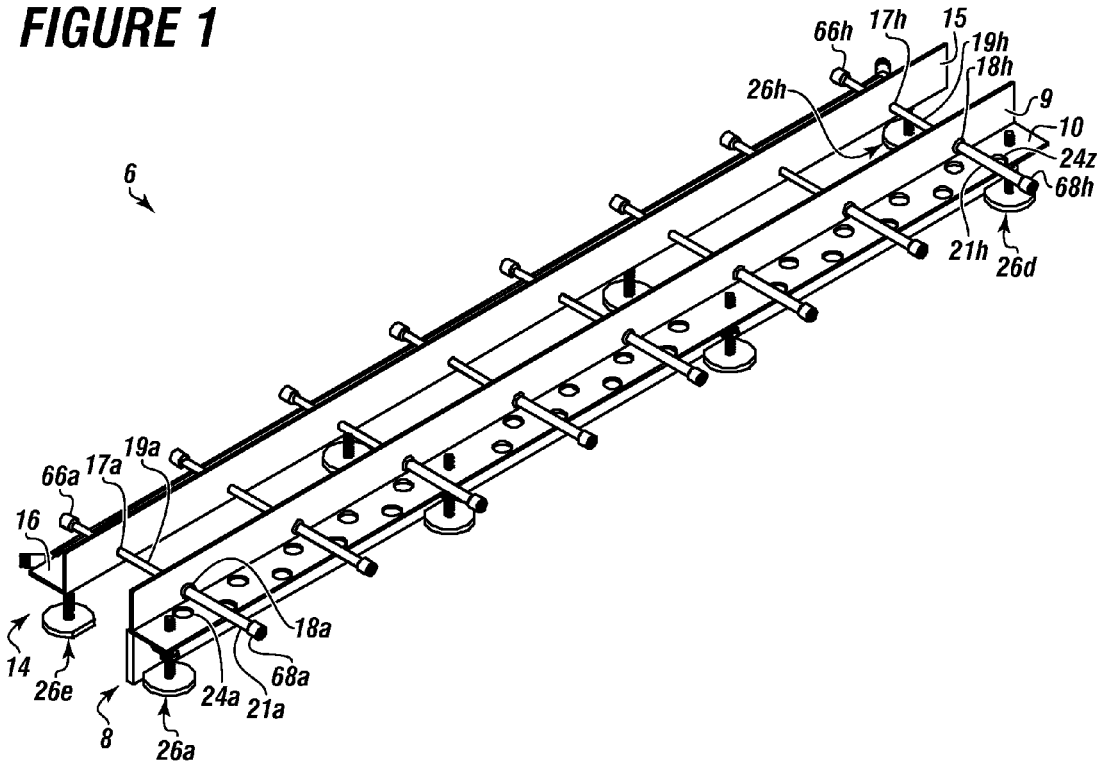
FIG. 1 is an isometric view of the thermal joint prior to insertion into the liquid curable flooring material.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it is practiced or carried out in various ways.

The embodiments relate to a thermal joint for cold storage construction having a cold side angle joint, a warm side angle joint, and a plurality of bond holes in each base of each angle joint allowing liquid curable flooring material to bond through each bond hole.

Additionally each warm side angle joint can have a plurality of rod holes formed in the warm side thermal wall.

Additionally each cold side angle joint can have a plurality of tube holes formed in the cold side thermal wall.

A plurality of leveler holes can be formed in each base, at least two per base of each angle joint.

An adjustable leveler can be inserted into each leveler hole.

A tube can be inserted into each tube hole.

A rod can be inserted into each rod hole.

A tie bar can engage each tube on one side and each rod on one side. Each tie bar can connect to a formed rebar grid or mat positioned over flooring insulation, wall insulation, or dirt.

A heater conduit can be longitudinally positioned for transferring heat to the warm base of the warm side angle joint.

As liquid curable flooring material is poured around the thermal joint, the liquid curable flooring material, as it cures, can form a structural matrix through the bond holes.

The thermal joint can engage the rebar tie-ins to slidably form an expandable floor joint, wherein the thermal joint can simultaneously (i) allow the thermal joint rods to slide in the thermal joint tubes as the cured solid flooring material expands and contracts due to temperature changes and (ii) prevent vertical deflection as heavy equipment is transported across the cured solid flooring material.

A benefit of the thermal joint is that it can allow the liquid curable flooring material to form a structural matrix through bond holes and prevent vertical deflection as heavy equipment weighing 3000 pounds to 5000 pounds per square inch is transported across the flooring material once cured.

In an embodiment, the cold side angle joint and warm side angle joint can be formed from a metal capable of resisting deformation at load pressure of from 3000 pounds to 5000 pounds per square inch.

A benefit of the thermal joint is that it can prevent cracking in a slab due to concrete shrinkage at door openings.

Another benefit of the thermal joint is that it can prevent equipment from falling on and injuring workers by preventing cracked or uneven concrete surfaces due to vertical deflection.

Another benefit of the thermal joint is that it can help prevent ice buildup on the floor in the cold storage section of the floor, which can lead to falls and injuries to workers, by allowing the heat conduit to transfer heat effectively at the joint.

The embodiments generally relate to a thermal joint for a flooring system.

The thermal joint can include a cold side angle joint having a cold side thermal wall connected at a right angle to a cold side base.

The cold side thermal wall can be from 12 inches to 8 feet long and made from a bar of iron. The bar can be from 1 inch to 6 inches in width and have a thickness from ⅛ inch to ¾ inches.

The warm side thermal wall can be identical to the cold side thermal wall.

The cold side base can have a plurality of bond holes formed through the cold side base. Each bond hole can allow a liquid curable flooring material to bond through each of the plurality of bond holes and form a complete structural matrix through the bond hole. The structural matrix, being a solid structure, can be more secure than cut material or separated material.

Each bond hole can have a diameter from 1 inch to 2 inches.

The liquid curable flooring material can be concrete or a resin based polymer.

The thermal joint can include a warm side angle joint having a warm side thermal wall connected at a right angle to a warm side base.

In embodiments, the warm side thermal wall can be the same width and thickness as the cold side thermal wall.

The warm side base can have a plurality of bond holes for allowing the liquid curable flooring material to bond through each of the plurality of bond holes.

The cold side thermal wall can be positioned in parallel and flush with the warm side thermal wall.

The thermal joint can include a plurality of rod holes formed in the warm side thermal wall.

The thermal joint can include a plurality of tube holes formed in the cold side thermal wall. The diameter of each tube hole, in an embodiment, can be larger than each diameter of each rod hole. The rod holes can align with the tube holes.

In an embodiment, the leveler hole can be a threaded hole and the adjustable leveler can include a foot with a threaded rod secured to the foot for threadably engaging the leveler hole.

The thermal joint can include a heater conduit fastened longitudinally along the warm side base.

The heater conduit can have a first heater conduit coupler one a first end of the heater conduit and a second heater conduit coupler on an opposite end of the heater conduit. The heater conduit receives heat at one end, such as a heated fluid, which then flows out the other end and enables the transfer of heat from the conduit to the warm side base and then to the flooring material. A resistance heater can be used to transfer heat along a wire that is snaked through the heater conduit. The resistance heater can engage a power supply to supply the heat.

The thermal joint can engage the rebar tie-ins to slidably form a moveable floor joint. A liquid curable flooring material can be flowed around the thermal joint while attached to the rebar, forming a structural matrix through the bond holes and simultaneously around the rods and tubes as the liquid state of the flooring cures into a solid.

The thermal joint can simultaneously have sliding thermal joint rods which slide snugly in the thermal joint tubes as the cured solid flooring material expands and contracts due to temperature changes. This embodiment, which has the structural matrix forming through the bond holes can prevent vertical deflection as heavy equipment is transported across the now cured solid flooring material.

In an embodiment, the heater can be a resistance heater or a heated fluid.

In an embodiment, the thermal joint can include a nut secured to the base opposite the wall for further threadably securing the adjustable leveler to the base of each angle joint.

In embodiments, when the flooring system is a concrete slab the first temperature can be at ambient, such as over 50 degrees Fahrenheit, and the thermal joint can separate the ambient side from the chilled side, wherein the chilled side is at a second temperature of less than 0 degrees Fahrenheit.

In an embodiment, the thermal joint can include rod holes and tube holes that are formed in the thermal walls at a density from at least 1 tube hole for each 12 inches of length of thermal wall to 2 tube holes for each 12 inches of length of thermal wall.

In embodiments, the flooring system, which can be a concrete slab, can have a first portion having a temperature from 40 degrees Fahrenheit to 120 degrees Fahrenheit and a second portion having a second temperature at a chilled temperature of −10 degrees Fahrenheit to 40 degrees Fahrenheit. The portions can be separated by the thermal joint.

In other embodiments, the thermal joint can include bond holes that are formed in a density from 1 hole to 6 holes per 12 inches of either warm side base or cold side base.

In an embodiment, the thermal joint can include bond holes that each have a diameter from 1 inch and 3 inches.

In an embodiment, the thermal joint can further comprise a thermal block for isolating solid flooring material adjacent the cold side angle joint wherein the thermal block engages a bracket for each adjustable leveler mounted through the leveler holes in the cold side base.

In embodiments, the thermal joint can be comprised in a manner wherein each cold side angle joint or warm side angle joint is iron.

In embodiments, the thermal joint can be comprised in a manner wherein each cold side angle joint or warm side angle joint is steel.

In another embodiment, the thermal joint can be comprised in a manner wherein each cold side angle joint or warm side angle joint is formed from a metal capable of resisting deformation at load pressures of from 3000 pounds to 5000 pounds per square inch.

In an embodiment, the thermal joint can be comprised in a manner wherein each rod and tube is stainless steel.

In embodiments, the thermal joint can be comprised in a manner wherein at least one of the angle joints is galvanized.

In an embodiment, the thermal joint can be comprised in a manner wherein at least one of the angle joints is encapsulated in a rust resistant powder coating.

Turning now to the Figures, FIG. 1 is an isometric view of the thermal joint 6 prior to engaging rebar and before flowing curable liquid flooring around the joint.

The cold side angle joint 8 is depicted with a cold side thermal wall 9 that can join a cold side base 10 at a right angle.

A warm side angle joint 14 is depicted with a warm side thermal wall 15 that can be connected at a right angle to a warm side base 16.

A plurality of rod holes 17*a*-17*h* can be formed in the warm side thermal wall 15.

A plurality of tube holes 18*a*-18*h* can be formed in the cold side thermal wall 9.

The rod holes can be aligned with the tube holes.

The rod holes can have a smaller diameter than the tube holes.

In an embodiment, the rod holes can have an outer diameter that matches the inner diameter of the tubes that are inserted into the tube holes.

A plurality of bond holes 24*a*-24*z* can be formed in the cold side base 10.

Figure 3:
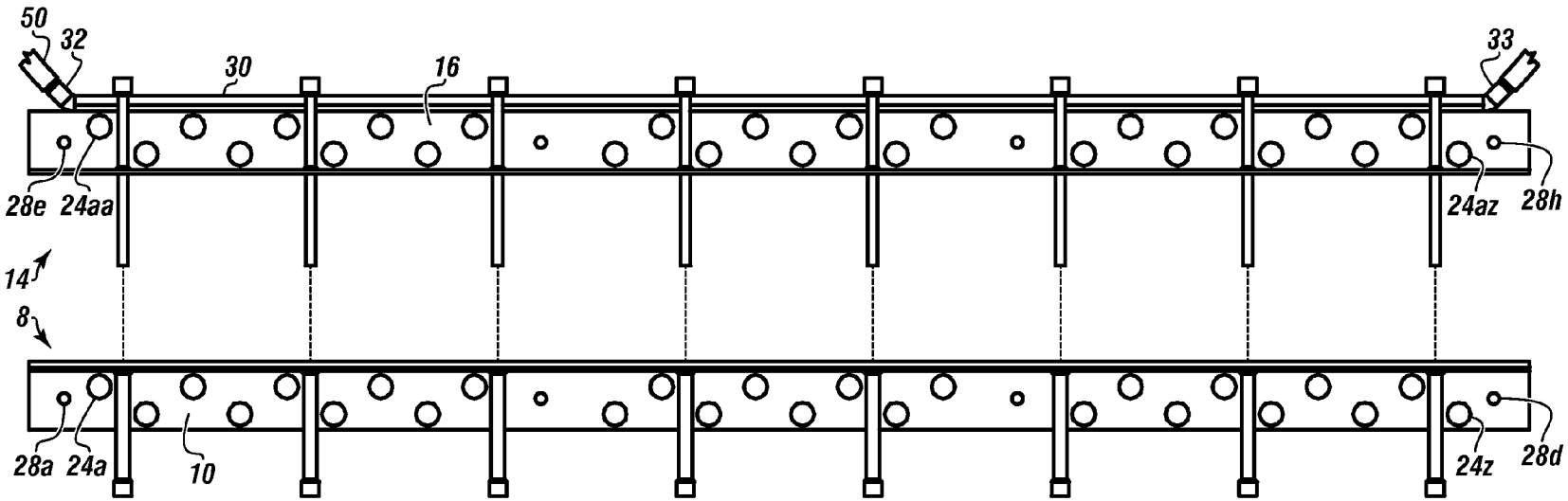
FIG. 3 is a top view of the thermal joint according to an embodiment.

Not shown in this FIG. 1 are a plurality of similar bond holes formed in the warm side base 16. FIG. 3 shows a plurality of similar bond holes 24*aa* to 24*zz* formed in the warm side base 16.

Returning to FIG. 1, a plurality of rods 19*a*-19*h* are shown with each rod penetrating one of the rod holes.

Tubes 21*a*-21*h* are shown, each tube penetrating one of the tube holes.

In embodiments, each tube can have a length from 4 inches to 12 inches. The inner diameter of the tubes can be ⅝ inches. The outer diameter of the tubes can be ¾ inches. The tubes can range in diameter from ⅜ inches to 1 inch in inner diameter.

In embodiments, each rod can have a length from 4 inches to 12 inches. The length of the rods can approximate or match the length of each tube.

The diameter of the rods can range from ⅜ inch to 1 inch.

The rods can fit into the tubes in a sliding, snug engagement. The rods can be friction fitted into the tubes. The tubes are not crimped in an embodiment.

Each rod and each tube can have a coupler.

Figure 2:
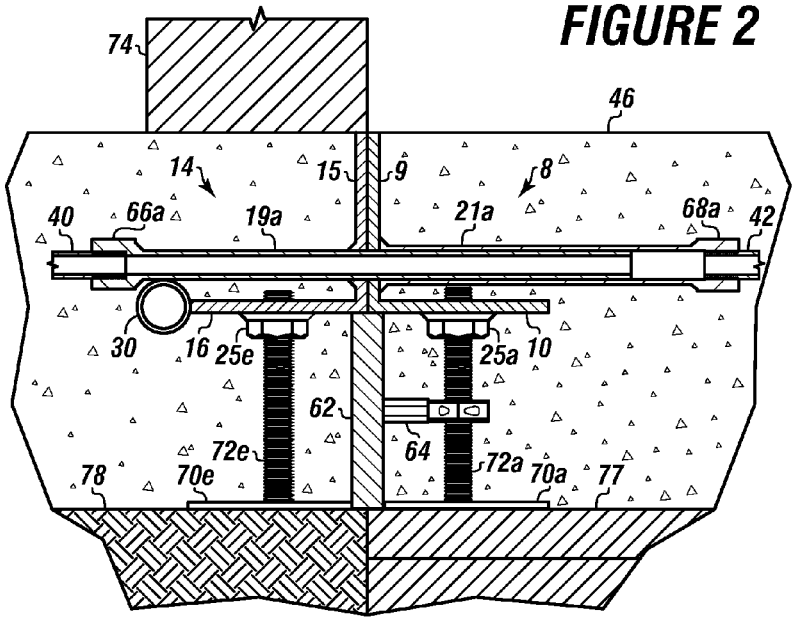
FIG. 2 is an end view of the thermal joint in a liquid curable flooring material.

Each rod can have a rod coupler 66*a*-66*h* for connecting to a first rebar tie-in as shown in FIG. 2

Each tube can have a tube coupler 68*a*-68*h* for connecting to a second rebar tie-in as shown in FIG. 2.

The first and second rebar tie-ins can engage rebar that is positioned in a grid in the flooring area before the liquid curable flooring is poured over the rebar and the thermal joint.

FIG. 1 shows adjustable levelers 26*a*-26*d* which are threaded or fastened, one each in one of the leveler holes in the cold side base. Adjustable levelers 26*e*-26*h* are shown threaded to the warm side base.

FIG. 2 depicts an end view of the thermal joint in a liquid curable flooring material 46.

Each adjustable leveler can have a leveler foot 70*a* and 70*e* with a leveler shaft 72*a* and 72*e*.

Each leveler shaft can be centrally positioned on the leveler foot wherein the shaft engages each leveler hole, allowing the base of each cold angle joint or warm angle joint to be adjusted in height to optimize positioning of the thermal joint if the floor or subsurface is not level.

In this view, the cold side angle joint 8 is flush with the warm side angle joint 14.

A first rod 19*a* can engage a first tube 21*a*.

A first rod coupling 66*a* can engage first rebar tie-in 40 on one end of the first rod opposite the first tube.

First tube coupling 68*a* can engage second rebar tie-in 42 on one end of the first tube opposite the first rod.

The first tube and the first rod can have a friction-tight sliding snug engagement that allows movement during thermal expansion and contraction and vertical deflection while loads of up to 3000 pounds to 5000 pounds per square inch are present on the cured solid flooring material.

In FIG. 2, nuts 25*a* and 25*e*, are depicted. One nut can be secured to each base of each angle joint encircling each leveler hole to allow each leveler shaft to threadably secure to each base through each leveler hole.

FIG. 2 also depicts the leveler feet 70*a* and 70*e*. Each leveler foot can rest on dirt 78 and floor insulation 77 respectively.

The leveler feet can stabilize the thermal joint and level the thermal joint over uneven surfaces.

The adjustable leveler of the cold side angle joint can be joined to a thermal block 62 via a bracket 64.

The thermal block, which can be wood, can extend from the cold side base to the floor insulation in this embodiment. The thermal block can be positioned beneath the thermal joint and the liquid curable flooring material can engage one side of the thermal block. Once cured, the thermal block can act to prevent heat transfer from the hot side to the cold side of the cured flooring material.

The thermal block can prevent bonding during the pouring of the curable liquid flooring material from the cold side flooring material which can be concrete to the warm side flooring material, which can also be concrete.

A wall 74 can be mounted over the cured solid flooring material.

Also shown in this Figure are the warm side thermal wall 15; cold side thermal wall 8; a heater conduit 30, which can be mounted to the warm side base 16; and the cold side base 10.

FIG. 3 is a top view of the thermal joint according to an embodiment, including the warm side angle joint 14 and the cold side angle joint 8.

The heater conduit 30 can be connected to a first heater conduit coupler 32 on a first side and a second heater conduit coupler 33 on a second side. The heater conduit couplers can be connected to the warm side base 16.

The heater conduit couplers can engage a heater 50. In an embodiment, the heater can allow a heated fluid can flow into one end of the heater conduit and flow along the heater conduit, transferring heat to the warm side base 16. No similar conduit is on the cold side base 10.

The first and second heater conduit couplers, in an embodiment, can be angled from 30 degrees to 45 degrees from a longitudinal axis of the heater conduit.

The bond holes 24*a*-24*zz* are shown in this Figure.

A plurality of leveler holes 28*a*-28*d* are shown formed in the cold side base 10 and a plurality of leveler holes 28*e*-28*h* are shown formed in the warm side base 16.

Figure 4:
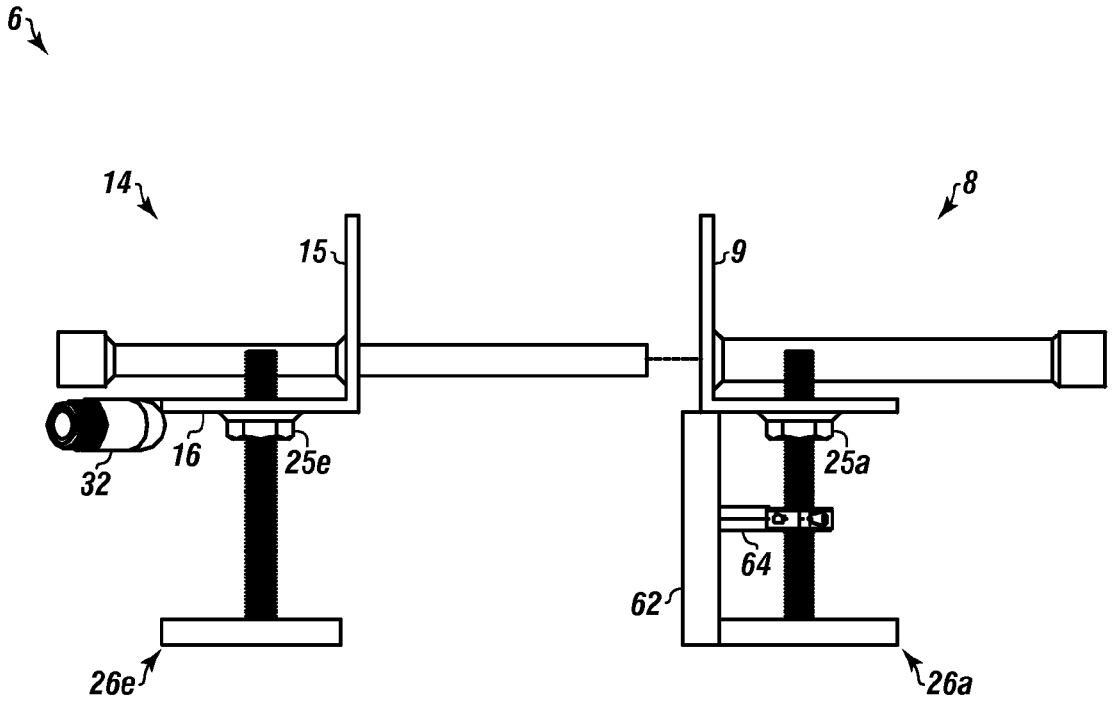
FIG. 4 depicts an end view of the thermal joint without being embedded in liquid curable flooring material.

FIG. 4 depicts an end view of the thermal joint 6 with the warm side angle joint 14 and the cold side angle joint 8 not embedded in a liquid curable flooring material.

A first adjustable leveler 26*a* and second adjustable leveler 26*e* are shown. In this embodiment, only the first adjustable leveler 26*a* is connected to the thermal block 62 with the bracket 64.

A heater conduit coupler 32 is shown engaging the warm side base 16.

Also shown in this Figure are the nuts 25*a* and 25*e*, the warm side thermal wall 15, and the cold side thermal wall 9.

While these embodiments have been described with emphasis on the embodiments, it should be understood that within the scope of the appended claims, the embodiments might be practiced other than as specifically described herein.

What is claimed is:

1. A thermal joint for a flooring system, the thermal joint comprising:

a. a cold side angle joint, wherein the cold side angle joint has a cold side thermal wall connected at a right angle to a cold side base, wherein the cold side base has a plurality of bond holes, and wherein the bond holes allow a liquid curable flooring material to bond through each of the plurality of bond holes;

b. a warm side angle joint, wherein the warm side angle joint has a warm side thermal wall connected at a right angle to a warm side base, wherein the warm side base has a plurality of bond holes, wherein the bond holes allow the liquid curable flooring material to bond through each of the plurality of bond holes, and wherein the cold side thermal wall is disposed in parallel and flush with the warm side thermal wall;

c. a plurality of rod holes that penetrate through the warm side thermal wall;

d. a plurality of tube holes that penetrate through the cold side thermal wall, wherein each diameter of each tube hole is larger than each diameter of each rod hole, and wherein the rod holes align with the tube holes;

e. a plurality of leveler holes formed in each base;

f. an adjustable leveler inserted into at least four of the leveler holes, two per base;

g. a rod inserted into each rod hole, wherein each rod has a rod coupling for receiving a first rebar tie-in;

h. a tube inserted into each tube hole, wherein each tube has a tube coupling for receiving a second rebar tie-in, and wherein each tube is adapted to engage one of the rods in a slidably resistive engagement; and i. a heater conduit fastened longitudinally along the warm side base, wherein the heater conduit has a first heater conduit coupler and a second heater conduit coupler for transferring heat from a heater; and wherein the thermal joint engages the rebar tie-ins to slidably form an expandable floor joint;

wherein the liquid curable flooring material is flowed in a liquid state around the thermal joint while attached to the rebar tie-ins, forming a structural matrix through the bond holes as the liquid state of the liquid curable flooring material cures into a solid; and wherein the thermal joint simultaneously (i) allows the rods to slide in the tubes as the cured solid flooring material expands and contracts due to temperature changes, and (ii) prevents vertical deflection as heavy equipment is transported across the cured solid flooring material.

2. The thermal joint of claim 1, wherein the heater is a resistance heater or a heated fluid.

3. The thermal joint of claim 1, further comprising at least one nut affixed to the warm side base, the cold side base, or combinations thereof, for further securing one of the adjustable levelers to the warm side base or cold side base.

4. The thermal joint of claim 1, wherein the leveler holes are formed in the bases at a density from at least two leveler holes to twelve leveler holes per foot to two leveler holes to twenty-four leveler holes per foot per base.

5. The thermal joint of claim 1, wherein the rod holes and the tube holes are formed in the thermal walls at a density from at least one tube hole for each 12 inches of length of thermal wall to two tube holes for each 12 inches of length of thermal wall.

6. The thermal joint of claim 1, wherein the flooring system is a concrete slab with a first portion of the flooring system having a temperature from 40 degrees Fahrenheit to 120 degrees Fahrenheit and a second portion having a second temperature at a chilled temperature of −10 degrees Fahrenheit to 40 degrees Fahrenheit, wherein the portions are separated by the thermal joint.

7. The thermal joint of claim 1, wherein the bond holes are formed in a density from one hole to six holes per 12 inches of either the warm side base or the cold side base.

8. The thermal joint of claim 1, wherein the bond holes each have a diameter from 1 inch to 3 inches.

9. The thermal joint of claim 1, further comprising a thermal block for isolating solid flooring material adjacent the cold side angle joint, wherein the thermal block engages a bracket for each adjustable leveler mounted through the leveler holes in the cold side base.

10. The thermal joint of claim 1, wherein each cold side angle joint or warm side angle joint is iron.

11. The thermal joint of claim 1, wherein each cold side angle joint or warm side angle joint is steel.

12. The thermal joint of claim 1, wherein each cold side angle joint or warm side angle joint is formed from a metal capable of resisting deformation at load pressures of from 3000 pounds to 5000 pounds per square inch.

13. The thermal joint of claim 1, where each rod and tube is stainless steel.

14. The thermal joint of claim 1, wherein at least one of the angle joints is galvanized.

15. The thermal joint of claim 1, wherein at least one of the angle joints is encapsulated in a rust resistant powder coating.

* * * * *